United States Patent [19]

Just

[11] Patent Number: 5,016,285

[45] Date of Patent: May 21, 1991

[54] NECKTIE

[76] Inventor: William J. Just, Suite 200, 91 W. Wieuca Rd., Atlanta, Ga. 30342

[21] Appl. No.: 523,424

[22] Filed: May 15, 1990

[51] Int. Cl.[5] ..... A41D 25/00

[52] U.S. Cl. ..... 2/144; 2/145; 2/246; 2/244; 2/DIG. 6

[58] Field of Search ..... 2/144, 145, 246, 244, 2/DIG. 6

[56] References Cited

U.S. PATENT DOCUMENTS

| | | | |
|---|---|---|---|
| 2,692,387 | 10/1954 | Spaniol | 2/144 |
| 2,918,678 | 12/1959 | Gouner | 2/144 |
| 3,484,974 | 12/1969 | Culmone | 2/DIG. 6 |
| 4,554,710 | 11/1985 | Grant . | |
| 4,611,355 | 9/1986 | Galanto | 2/246 |
| 4,723,323 | 2/1988 | Wright, Jr. . | |
| 4,776,043 | 10/1988 | Coleman . | |
| 4,835,821 | 6/1989 | Durante . | |
| 4,856,115 | 8/1989 | Knapp . | |
| 4,860,387 | 8/1989 | Williams | 2/244 |
| 4,875,239 | 10/1989 | Patterson, Jr. . | |
| 4,918,758 | 4/1990 | Rendina | 2/DIG. 6 |

*Primary Examiner*—Werner H. Schroeder
*Assistant Examiner*—Gloria Hale
*Attorney, Agent, or Firm*—Wigman & Cohen

[57] ABSTRACT

A necktie is disclosed comprising a front panel having projecting loops (or hooks) to receive ornaments thereon. The rear surface of the ornament is provided with projecting hooks (or loops) so that, together with the tie a fastening system is provided. Cartoon and other type ornaments are provided.

10 Claims, 1 Drawing Sheet

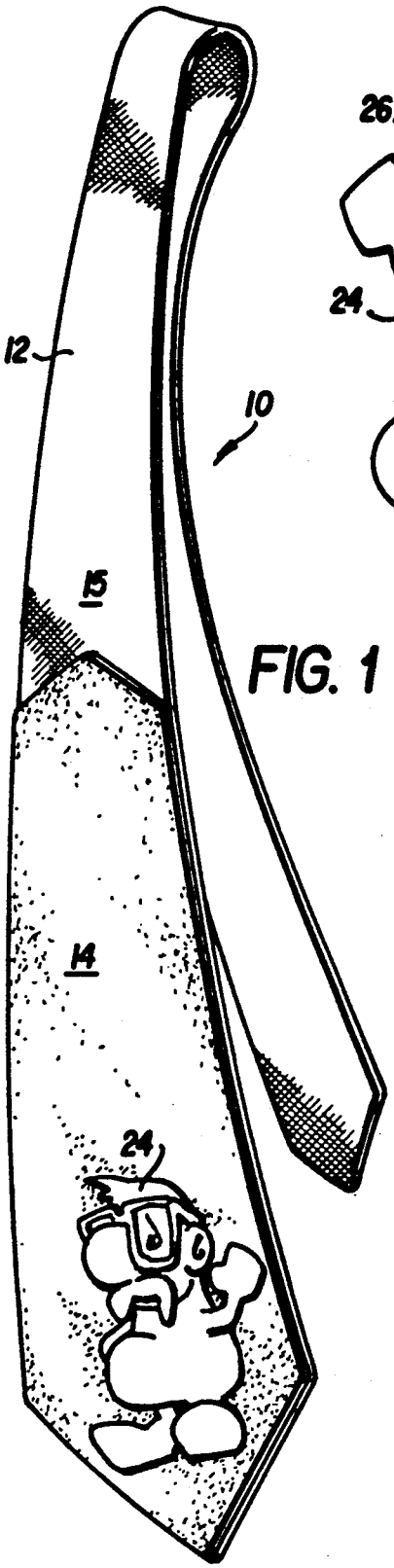
FIG. 1
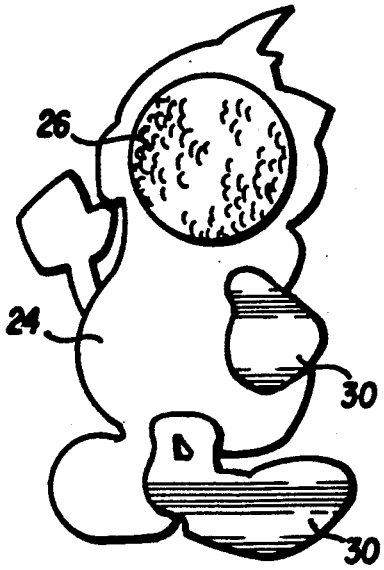
FIG. 4
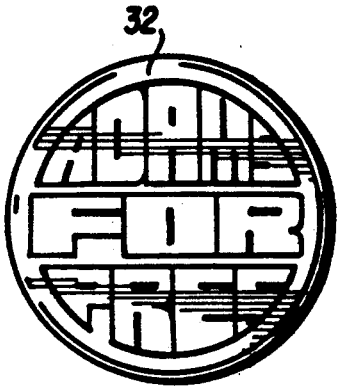
FIG. 5
FIG. 2
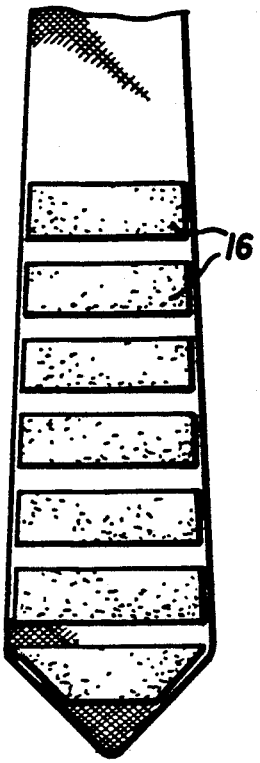
FIG. 3
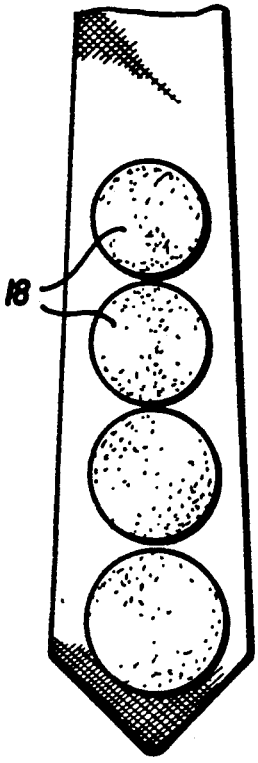

NECKTIE

BACKGROUND OF THE INVENTION

This invention relates generally to a necktie, and more particularly to a necktie having a removable ornaments, insignia and indicia.

It is well-known that the typical American male regularly purchases a large quantity of neckware in order to match his wardrobe, enhance variety and respect fashion trends and styles. This practice is clearly expensive, especially as the cost of silk and other materials used in the construction of most neckties increases.

Some consumers are desirous of wearing neckties which display unique indicia, designs, logos and the like during special events and occasions. For example, sporting events, religious holidays, conventions, political campaigns, and the like present opportunities for novel neckwear designs and indicia. However, it is not cost effective for most consumers to purchase neckwear for use on only a few occasions. Moreover, attaching pins, buttons and the like causes permanent damage to the tie.

Another disadvantage with conventional neckware is its lack of appeal to young children, who are known to grimace at even the thought of wearing a necktie. Children often associate neckware with formality, conservatism, and restriction rather than fun and playfulness.

An attempt to obviate the aforementioned problem of the invariability of most neckware includes U.S. Pat. No. 2,692,387 to Spaniol. Spaniol teaches a necktie with interchangeable ornaments secured to the tie by means of screws and nuts. A key disadvantage of this type of device is the fact that it is cumbersome to secure and remove the ornaments using a crew and bolt. This is especially true for younger wearers. Additionally, with this prior art device the number and placement of ornaments are limited to the holes provided.

SUMMARY AND OBJECTS OF THE INVENTION

In view of the foregoing, it should be apparent that a need still exists in the art for a necktie upon which ornaments, stripes and indicia may be removably attached in order to vary the appearance thereof and which overcomes the problems inherent in the prior art.

It therefore a primary object of this invention to provide a necktie with removable ornamentation wherein the placement or removal of the ornaments is simple, quick and not cumbersome.

Another object of this invention is to provide a necktie with removable ornamentation wherein ornaments may be placed in a variety of places and positions along the face of the tie.

Another object of this invention is to provide a necktie with removable ornamentation wherein ordinary figures and similar objects can easily be adapted to be affixed to the tie.

Another object of this invention is to provide a necktie with removable ornamentation which is inexpensive to manufacture.

Another object of this invention is to provide a necktie with removable ornamentation which is suitable for use by small children.

These and other objects and advantages that may become apparent hereinafter are accomplished in accordance with this invention by providing a necktie having a looped-Velcro® surface secured to the front panel thereof. An ornament, insignia or similar indicia is adapted to include a hooked Velcro® surface secured to the back side thereof. This arrangement permits removable attachment of the ornament to the front panel of the tie.

With the foregoing and other objects, advantages and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWINGS

FIG. 1 is a perspective view of the necktie and attached ornament of the present invention.

FIG. 2 is a front elevation view of a first alternative embodiment of the present invention;

FIG. 3 is a front elevation view of a second alternative embodiment of the present invention;

FIG. 4 is a rear elevation view of a typical ornament which may be utilized in accordance with the present invention; and FIG. 5 is a typical political button for attachment to the tie made in accordance with the present invention.

DETAILED DESCRIPTION OF THE PREFERRED EMBODIMENTS

Referring now in detail to the drawings wherein like parts are designated by like reference numerals throughout, there is illustrated in FIG. 1 a perspective view of the necktie of the present invention designated generally by reference numeral 10. Necktie 10 comprises a long, narrow band of fabric 12 adaptable to be worn around the user's neck and tied in a knot close to the throat, with the ends left hanging down the shirt front. An overlay 14 constructed of the loop (or hook) portion of a conventional hook-and-loop fastener system, such as Velcro®, is attached to the front panel of the tie at the lower portion of the band 12. Attachment of the overlay 14 to the tie may be accomplished by sewing or by an adhesive, or by any other expedient manner.

Alternative arrangements of the present invention are illustrated in FIGS. 2 and 3. In FIG. 2, a plurality of spaced patches 16 of loop (or hook) construction are appropriately secured to the front panel of the tie in a striped arrangement. Also contemplated as an alternative embodiment (not shown) is a tie with a permanent knot having means for securing the tie to the collar known in the art as a "clip-on" tie. The arrangement of FIGS. 2 and 3 allow the wearer to vary the colors of the stripes with each use. He need merely procure a collection of striped patches in a variety of colors and select the appropriate colored stripes to match a particular wardrobe. In the embodiment illustrated in FIG. 3 circular patches 18 of looped Velcro® material are provided. Other shapes and arrangements of the overlay material may be used according to the present invention.

In use, one or more ornaments 24, as shown in FIG. 1, is removably attached to overlay 14. The back side of ornament 24 is preferably provided with the hook portion 26 of the fastener system so that the ornament 24, 32 can be readily moved and removed from the overlay 14 or patches 16, 18.

A variety of ornaments may be provided for decorative or informative purposes. For example, children will prefer ornaments formed of well-known cartoon characters, such as, Mickey Mouse, Donald Duck, Roger Rabbit and the like. On the other hand, adults will prefer ornaments, such as insignias political messages, company names, and perhaps sports emblems or the like. One or more flat surfaces 30 are provided on the back side of the ornament (FIG. 4) to receive the appropriate hook (or loop) material. In this manner, the ornament 24, 32 can readily be attached to the tie front panel overlay 14 and thereafter removed. If desired, a combination of cartoon characters and buttons having indicia thereon can be used at the same time.

In sum, the above-described invention has several important advantages over the prior art. First, the invention provides the wearer the ability to affix various ornaments or to vary the pattern of the face of the tie with minimum expense or difficulty. Second, the use of Velcro® as a fastening means allows easy attachment and removal of the ornamentation even by small children. Third, the use of Velcro® as a fastening means allows ordinary figures, insignias and the like to be easily adapted to be affixed to the tie.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A necktie comprising:

a front panel;

said front panel including means for removably receiving one or more ornaments thereon;

said front panel and said ornament including a hook-and-loop fastener system whereby said ornament is easily affixed to said front panel for one of decorative and display purposes;

said means for removeably receiving said ornaments, including an overlay fixedly attached to said front panel, said overlay extending continually over a substantial portion of said front panel and comprising a plurality of loops for receiving hooks projecting from the rear surface of said ornament to be placed thereon.

2. The necktie according to claim 1, further including an ornament having a rear surface, comprising a plurality of projecting hooks for removable attachment to loops projecting from said necktie.

3. The necktie according to claim 1, wherein said ornament is a cartoon character.

4. The necktie according to claim 1, wherein said ornament includes indicia thereon.

5. The necktie according to claim 1, wherein said ornament includes sports related designs.

6. A necktie comprising:

a front panel;

said front panel including means for removably receiving one or more ornaments thereon;

said front panel and said ornament including a hook-and-loop fastener system whereby said ornament is easily affixed to said front panel for one of decorative and display purposes;

said means for removeably receiving said ornaments, including an overlay fixedly attached to said front panel, said overlay extending continually over a substantial portion of said front panel and comprising a plurality of hooks for receiving loops projecting from the rear surface of said ornament.

7. The necktie according to claim 6, further including an ornament having a rear surface comprising a plurality of projecting loops for removable attachment to hooks projecting from said necktie.

8. The necktie according to claim 6, wherein said ornament is a cartoon character.

9. The necktie according to claim 6, wherein said ornament includes indicia thereon.

10. The necktie according to claim 6, wherein said ornament includes sports related designs.

* * * * *

UNITED STATES PATENT AND TRADEMARK OFFICE

CERTIFICATE OF CORRECTION

PATENT NO. : 5,016,285

DATED : May 21, 1991

INVENTOR(S) : William J. JUST

It is certified that error appears in the above-identified patent and that said Letters Patent is hereby corrected as shown below:

Column 1, line 35, "crew and bolt" should be --screw and bolt--;

line 47, "It therefore" should be --It is therefore--.

Claim 1 should read as follows:

--1. A necktie comprising:

a front panel, including an overlay fixedly attached thereon, said overlay extending over a substantial portion of said front panel;

said overlay including means for removably receiving one or more ornaments thereon;

said overlay and said ornament including a hook-and-loop fastener system whereby said ornament is easily affixed to said overlay for one of decorative and display purposes;

said means for removably receiving said ornaments comprising a plurality of loops for receiving hooks projecting from the rear surface of said ornament to be placed thereon.--

UNITED STATES PATENT AND TRADEMARK OFFICE

CERTIFICATE OF CORRECTION

PATENT NO. : 5,016,285

DATED : May 21, 1991

INVENTOR(S) : William J. Just

It is certified that error appears in the above-identified patent and that said Letters Patent is hereby corrected as shown below:

Claim 6 should read as follows:

--6. A necktie comprising:

a front panel, including an overlay fixedly attached thereon, said overlay extending over a substantial portion of said front panel;

said overlay including means for removably receiving one or more ornaments thereon;

said front panel and said ornament including a hook-and-loop fastener system whereby said ornament is easily affixed to said overlay for one of decorative and display purposes;

said means for removably receiving said ornaments comprising a plurality of hooks for receiving loops projecting from the rear surface of said ornament.--

Signed and Sealed this

First Day of December, 1992

*Attest:*

DOUGLAS B. COMER

*Attesting Officer* *Acting Commissioner of Patents and Trademarks*